US005480111A

United States Patent [19]

Smith et al.

[11] Patent Number: 5,480,111

[45] Date of Patent: Jan. 2, 1996

[54] MISSILE WITH DEPLOYABLE CONTROL FINS

[75] Inventors: John D. Smith; Ryan D. Lamberton, both of Tucson, Ariz.

[73] Assignee: Hughes Missile Systems Company, Los Angeles, Calif.

[21] Appl. No.: 242,393

[22] Filed: May 13, 1994

[51] Int. Cl.[6] ..... F42B 10/14

[52] U.S. Cl. ..... 244/3.27; 244/3.29

[58] Field of Search ..... 114/23; 244/3.27, 244/3.28, 3.29

[56] References Cited

U.S. PATENT DOCUMENTS

| | | | |
|---|---|---|---|
| 3,063,375 | 11/1962 | Hawley et al. | 244/3.27 |
| 4,664,339 | 5/1987 | Crossfield | 244/3.28 |
| 4,667,899 | 5/1987 | Wedertz | 244/3.27 |

FOREIGN PATENT DOCUMENTS

| | | | |
|---|---|---|---|
| 2238856 | 6/1991 | United Kingdom | 244/3.27 |

*Primary Examiner*—Charles T. Jordan
*Assistant Examiner*—Theresa M. Wesson
*Attorney, Agent, or Firm*—R. M. Heald; C. D. Brown; W. K. Denson-Low

[57] ABSTRACT

A missile (20) includes a missile body (22) and a structure for controlling the flight path of the missile body. The control structure includes at least one control fin (28) and an actuator shaft (38) that supports the control fin (28) for rotational missile control movement about a control axis (30) perpendicular the axis (23) of the missile body (22). A deployment shaft (42) extending from the control fin (28) is rotatable in a deployment shaft bore (46) in the actuator shaft (38), and permits the control fin (28) to rotate from a folded position (56) parallel and adjacent to the missile body (22) to a extended position (58) parallel to the control axis (30)

9 Claims, 5 Drawing Sheets

FIG. 1.
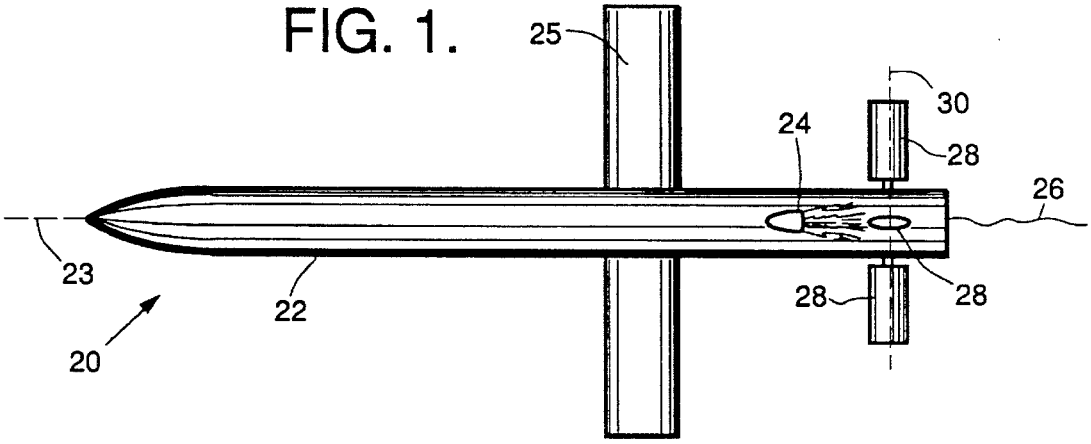
FIG. 3.
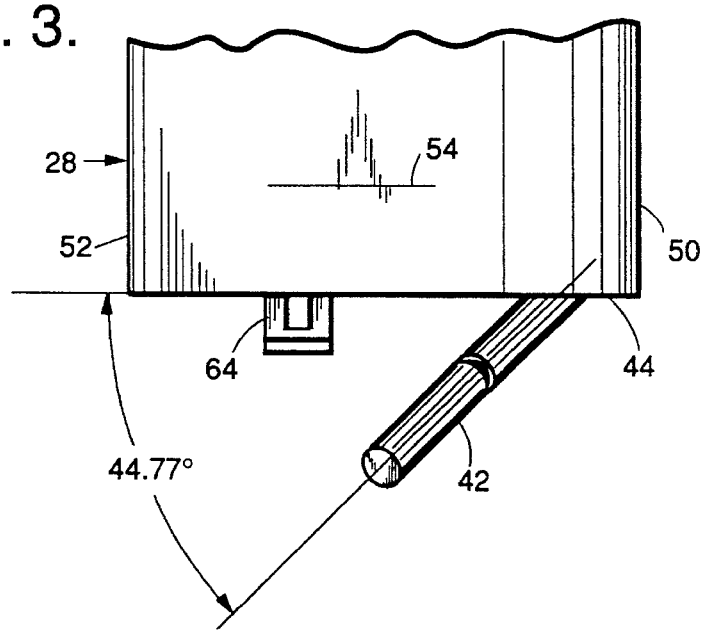
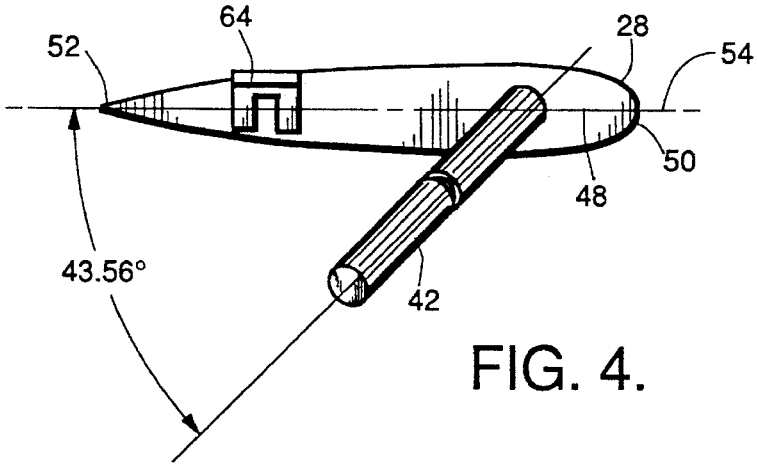
FIG. 4.

MISSILE WITH DEPLOYABLE CONTROL FINS

BACKGROUND OF THE INVENTION

This invention relates to controllable missiles, and, more particularly, to a missile with deployable control fins.

Some types of guidable armaments, such as guided missiles, utilize two or four control fins to effect the guidance of the missile. The control fins project outwardly from the sides of the missile during self-controlled flight. The control fins typically have a symmetric airfoil shape that is oriented edge-on or slightly upwardly inclined to the air flow when the missile is flying in a straight line. To change the flight path, the control fins are slightly reoriented, singly or in groups, by the aircraft's control system. One approach to mounting and orienting the control fins is to carry the control fins on shafts that project at right angles to the axis of the body of the missile. The attitude of the control fin to the air flow is changed by rotating the shafts by small amounts.

The control fins project outwardly from the sides of the missile when the missile is in self-controlled flight. It is desirable in many cases that the control fins be positioned against the body of the missile during storage and mounting in a vehicle or aircraft, prior to use. This stowed position of the control fins reduces the effective diameter of the missile, permitting more missiles to be stored and/or carried in a limited space. It also reduces the likelihood of damage to the control fins or their mechanisms during storage and handling.

Thus, it is known to fold the control fins against the sides of the missile body during storage and handling; and to deploy the control fins to an extended position shortly after the launch of the missile. Various relatively complex mechanisms have been developed to permit the fins to be folded, deployed, locked into the deployed position, and thereafter to be moved (usually rotated) by an actuator system. Mechanisms have also been known to permit rotational deployment of wings that are stationary and not moved by an actuator after deployment.

The more complex is the mechanism, the heavier it tends to be, the more prone to failures, and the more expensive. Moreover, the complex deployment mechanisms typically occupy a relatively large volume, a significant disadvantage because of the limited space available within the bodies of most missiles. There is a need for a simple, reliable, compact mechanism for supporting, deploying, locking, and controllably moving control fins of missiles. The present invention fulfills this need; and further provides related advantages.

SUMMARY OF THE INVENTION

The present invention provides a missile having a reliable yet lightweight control fin mounting structure. The mounting structure permits the control fin to be folded against the side of the missile during handling and storage; and then deployed to an extended position with a single rotational movement. The control fin is locked in the extended position and thereafter is fully controllable by rotational movement of an actuator. The deployment and support mechanism is compact; and also produces a small overall cross-sectional area of the missile when the fins are folded so that the missile can be stored in a small space.

In accordance with the invention, a missile comprises a missile body having a missile body axis and means for controlling the flight path of the missile body. The means for controlling includes a control fin, means for supporting the control fin for rotational movement about a control axis perpendicular to the missile body axis, and means for deploying the control fin by a rotational movement about a deployment axis from a folded position parallel and adjacent to the missile body to a extended position parallel to the control axis. The means for controlling further includes means for controllably rotating the control fin about the control axis when the control fin is in the extended position. In a typical application, there are four control fins, each with a respective means for supporting, means for deploying, and means for controllably rotating.

In one embodiment, the control fin is supported on an actuator shaft rotationally driven by an actuating mechanism. In this mechanism, an actuator is linked to the actuator shaft by a linkage or other operable structure. The means for deploying includes a deployment shaft extending from the control fin in a direction that is not parallel to the actuator shaft; and a deployment shaft bore in the actuator shaft. The deployment shaft is rotatably received within the deployment shaft bore.

In this design, the control fin is initially in its folded position. Upon launch of the missile, the control fin rotates about the deployment shaft to the extended position and is permanently locked in that extended position. The deployment shaft supports the control fin on the actuator shaft, and the locking mechanism prevents the control fin from rotating or folding relative to the actuator shaft. The actuator shaft thereafter rotated by the actuating mechanism to effect control movements of the missile.

This approach provides a rugged, reliable, compact, lightweight missile control structure. The control fin is mounted to the actuator shaft by the deployment shaft, and both shafts can be made sufficiently large in size to support any anticipated aerodynamic or control loadings. The actuating mechanism need only rotate the actuator shaft, which is supported in bearings but is otherwise not required to move, either during deployment or during control operations. There is no hinge, linkage, or other mechanism in the portion of the structure that bears the structural and aerodynamic loadings, reducing the likelihood of failures. A linkage is ordinarily provided to connect the actuator to the actuator shaft, but this linkage does not bear structural or aerodynamic loadings. Finally, the approach of the invention leads to a compact structure in two ways. First, the deployment and actuating mechanism is itself compact. Second, the overall cross sectional size of the missile with the fins folded is smaller than with other types of deployment and actuating mechanisms, giving the missile a small cross-sectional area for storage.

The present invention therefore provides an improvement in missiles that are controlled by deployable control fins and associated actuators. Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 1 is a schematic plan view of a missile using deployable control fins;

FIG. 3 is a plan view of a portion of a control fin and Its deployment shaft;

FIG. 4 is an end elevational view of the control fin and deployment shaft of FIG. 3;

DETAILED DESCRIPTION OF THE INVENTION

Figure 2:
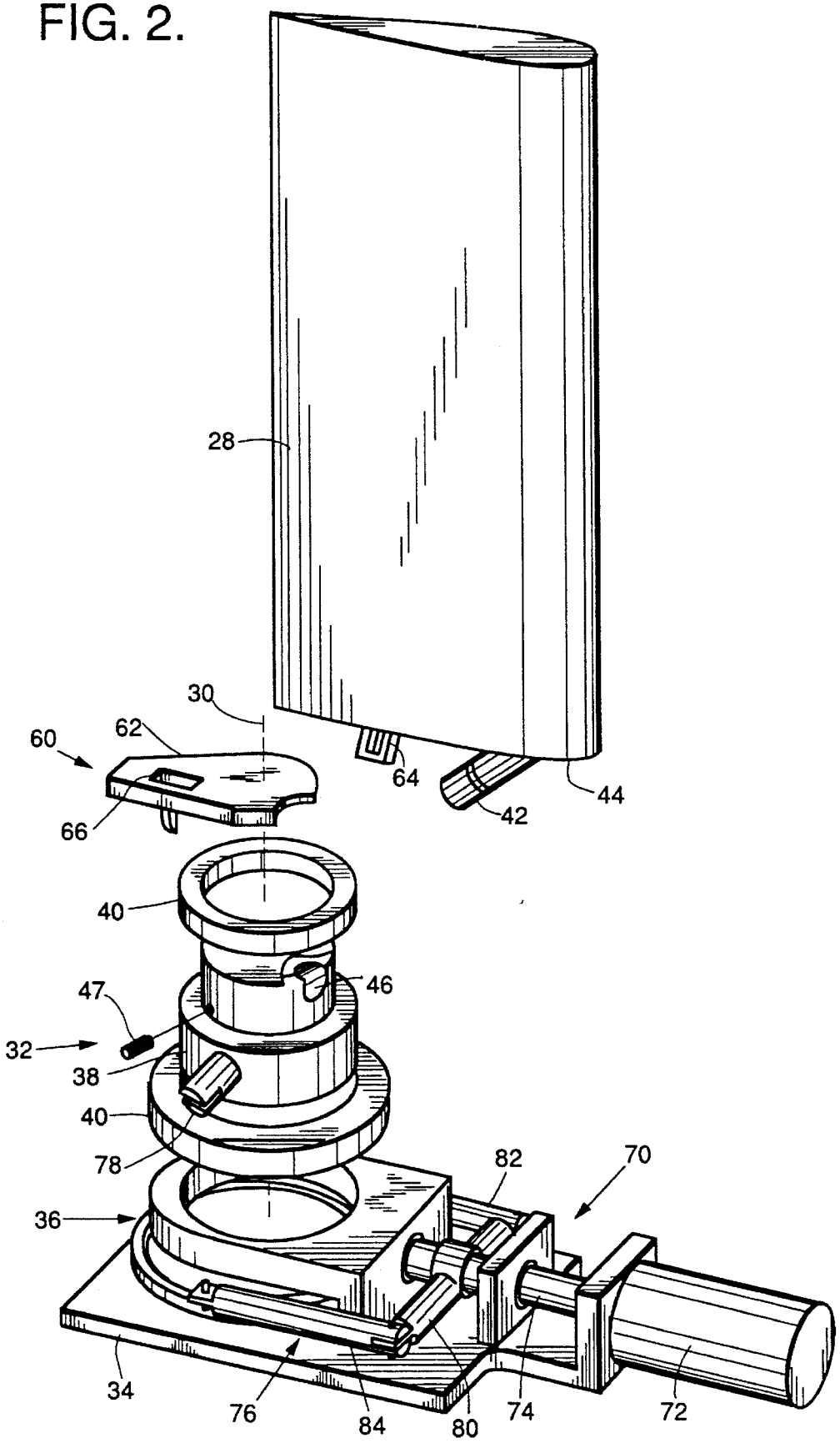
FIG. 2 is an exploded perspective view of a control fin and actuator system.

FIG. 1 depicts a missile 20 that utilizes the approach of the invention. The missile 20 includes a missile body 22 having a missile body axis 23 and a propulsion system, here shown as a single rocket engine that is mounted so that it exhausts through a nozzle 24 on the top of the missile body 22. In a preferred form of the missile, there are four wings 25 extending outwardly from a location forward of the rocket engine nozzle 24. An optical fiber 26 is payed out behind the missile 20 from a canister within the missile as the missile flies, permitting information to be communicated between the missile 20 and a control station (not shown). The top-mounted nozzle 24 of the rocket engine is oriented so that the engine exhaust does not impinge upon the optical fiber 26. The present invention is equally operable with other missile types, such as a missile having a tail-mounted engine, multiple engines, or wing-mounted engines; or with a missile having no optical fiber guidance system; or a missile having no engines such as a laser-guided bomb. All such devices are within the scope of the term "missile" as used herein. Although the preferred embodiment deals with a missile that flies through the air, the term "missile" as used herein also includes torpedoes as well.

Four control fins 28 are supported at equal spacings around the missile body 22, in this case at a station aft of the engine nozzle 24. Each of the control fins 28 is an aerodynamic surface which is rotatable about a respective control axis 30 that is perpendicular to the missile body axis 23. The control of the missile is achieved by rotating the respective control fins 28 about their axes in complex patterns commanded by a missile guidance controller. The present invention deals with the support, deployment, and rotation of the control fins; and is not concerned with the orientations of the control fins required to achieve particular flight paths of the missile.

The control fins 28 are initially folded against the missile body 22 during storage and handling. In this folded position, the control fins 28 are parallel and adjacent to the missile body 22. Shortly after the missile 20 is launched, the control fins 28 deploy to an extended position shown in FIG. 1. The control fins 28 must thereafter be rotatable about the control axis 30 to permit control of the flight path of the missile 20.

A preferred mounting structure 32 for accomplishing the movement from the folded position to the extended position, locking the control fin in the extended position, and subsequently controllably rotating the control fin is shown in the exploded perspective view of FIG. 2. The structure 32 includes a base 34 upon which an actuator shaft housing 36 is mounted. An actuator shaft 38 is rotatably mounted within the actuator shaft housing 36 using a pair of bearings 40. The axis of rotation of the actuator shaft 38 coincides with the control axis 30 of the respective control fin 28.

The control fin 28 includes a deployment shaft 42 that extends from an inboard end 44 of the control fin 28. The actuator shaft 38 includes a deployment shaft bore 46 in its side. The deployment shaft bore 46 is large enough to receive the deployment shaft 42 therein, with a rotatable fit that permits the deployment shaft 42 to rotate within the deployment shaft bore 46. When assembled, the deployment shaft 42 is retained within the deployment shaft bore 46 by a retaining screw 47.

The deployment shaft 42 is fixedly oriented with respect to the control fin 28 in a manner such that, when the deployment shaft 42 is rotated in the deployment shaft bore 46, the control fin 28 moves from the folded position to the extended position. In the preferred embodiment, the deployment shaft 42 is oriented in the manner shown in FIGS. 3 and 4. The control fin 28 generally has an airfoil shape about an airfoil plane 48. Lying within the airfoil plane 48, and extending generally perpendicularly between a leading edge 50 and a trailing edge 52 of the airfoil, is a longitudinal axis 54.

With respect to these definitions, the deployment shaft 42 is preferably oriented at an angle of about 44.8 degrees to the longitudinal axis 54 measured in the airfoil plane 48 (see plan view of FIG. 3); and at an angle of about 43.6 degrees to the longitudinal axis 54 measured perpendicular to the airfoil plane 48 (see elevational view of FIG. 4). Other operable orientations can also be used.

The deployment shaft bore 46 is preferably oriented at angle of about 54.3 degrees to the axis of the actuator shaft 98, which is itself coincident with the control axis 30. When the mechanism is assembled, the deployment shaft 42 is therefore oriented at this angle of about 54.3 degrees to the control axis 30. Other operable orientations can also be used.

Figure 5:
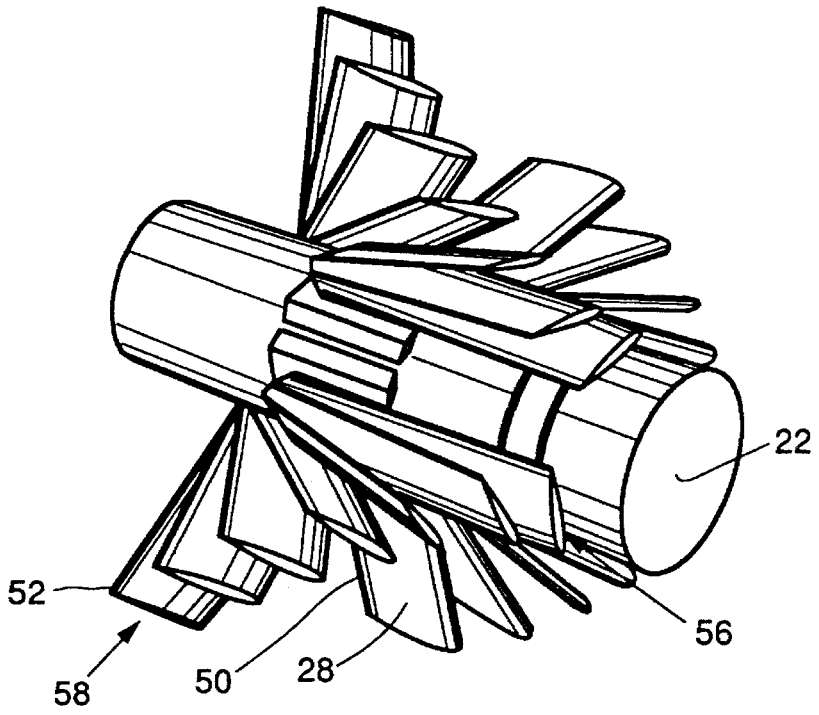
FIG. 5 is a schematic perspective view of a portion of the missile of FIG. 1, showing the sequence of events during deployment of the control fins.
Figure 6:
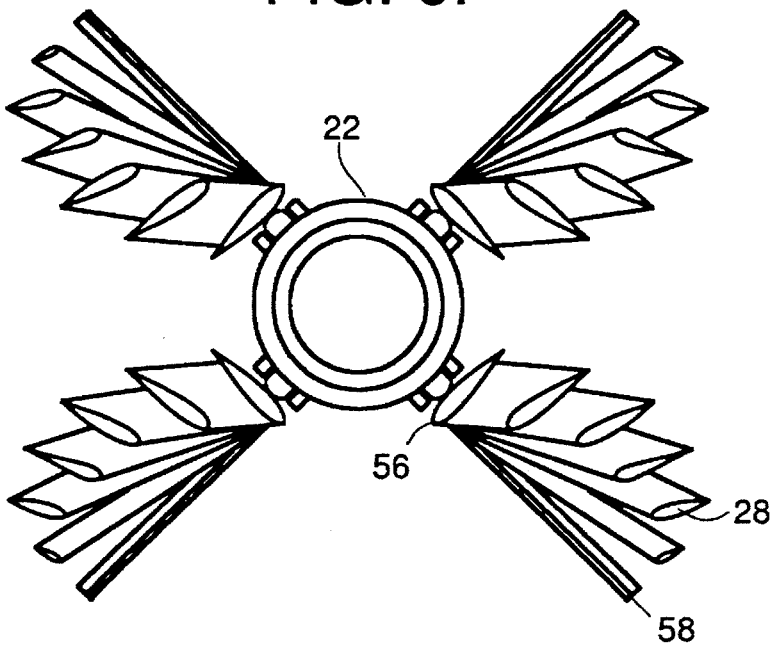
FIG. 6 is a schematic end elevational view of the missile of FIG. 5, showing the sequence of events during deployment of the control fins.

FIGS. 5 and 6 illustrate, in two views, the sequence of events as the control fins 28 are each deployed from their initial folded position (numeral 56) lying flat against the missile body 22; to the extended position (numeral 58). In the preferred embodiment, in the folded position 56 the control fins 28 fold forwardly and deploy by movement of the tips of the control fins 28 backwardly. This approach is chosen so that the inertial and aerodynamic forces experienced by the missile 20 as it is launched aid in the deployment of the control fins rather than work against the deployment.

As shown in FIGS. 5 and 6, the rotation of the deployment shaft 42 causes the entire control fin 28 to open outwardly and simultaneously rotate with the deployment shaft to the proper aerodynamic orientation with the leading edge 50 pointing generally forwardly for subsequent flight. Consequently, no hinge or comparable structure is required, a distinct advantage inasmuch as such structure can be a weak point in the mechanism. The structure using the deployment shaft is more robust and less likely to fail or experience difficult operation after an extended storage period.

After the control fin 28 has rotated outwardly to the extended position 58, it must be prevented from rotating too far and must be locked in the proper position for flight. Otherwise, the control fin 28 might move to an incorrect and undesired orientation, or even refold, during flight.

To stop the rotation of the control fin 28 and to lock the control fin 28 in the extended position 58, a combined stop and locking structure 60 is provided, as shown in FIG. 2. A stop plate 62 is fixed to the actuator shaft 38, with the flat face of the plate 62 parallel to the inboard end 44 of the control fin 28 when the control fin 28 is in the extended position 58. That is, the face of the stop plate 62 is perpendicular to the control axis 30, in the preferred embodiment. The stop plate 62 is positioned along the control axis 30 at a location such that the control fin 28 is free to rotate to its extended position 58 before encountering the stop plate 62.

A locking latch 64 is provided on the control fin 28. The locking latch 64 is preferably in the form of a tongue of metal that extends downwardly from the inboard end 44 of the control fin 28. A locking latch receiver 66 is provided on the stop plate 62. The locking latch receiver 66 is preferably in the form of a slot positioned so that the locking latch 64 slides into the slot as the control fin 28 contacts the stop plate 62. The engagement between the locking latch 64 and the locking latch receiver 66 prevents the control fin 28 from rotating about the deployment shaft 42 back toward the folded position 56, once the extended position 58 has been reached. For most applications, it is not necessary to provide for later disengagement of the locking latch 64 and the locking latch receiver 66, as the missile is used only one time.

Once the control fin 28 is deployed to the extended position 58 and locked into place, which typically occurs shortly after launch of the missile 20, the control fin 28 is available for rotational control movements that are used to steer the missile 20. In this position, the control fin 28 is rigidly supported on and locked to the actuator shaft 38. Rotation of the control fin 28 is thereby accomplished by controllably rotating the actuator shaft 38.

Figure 7:
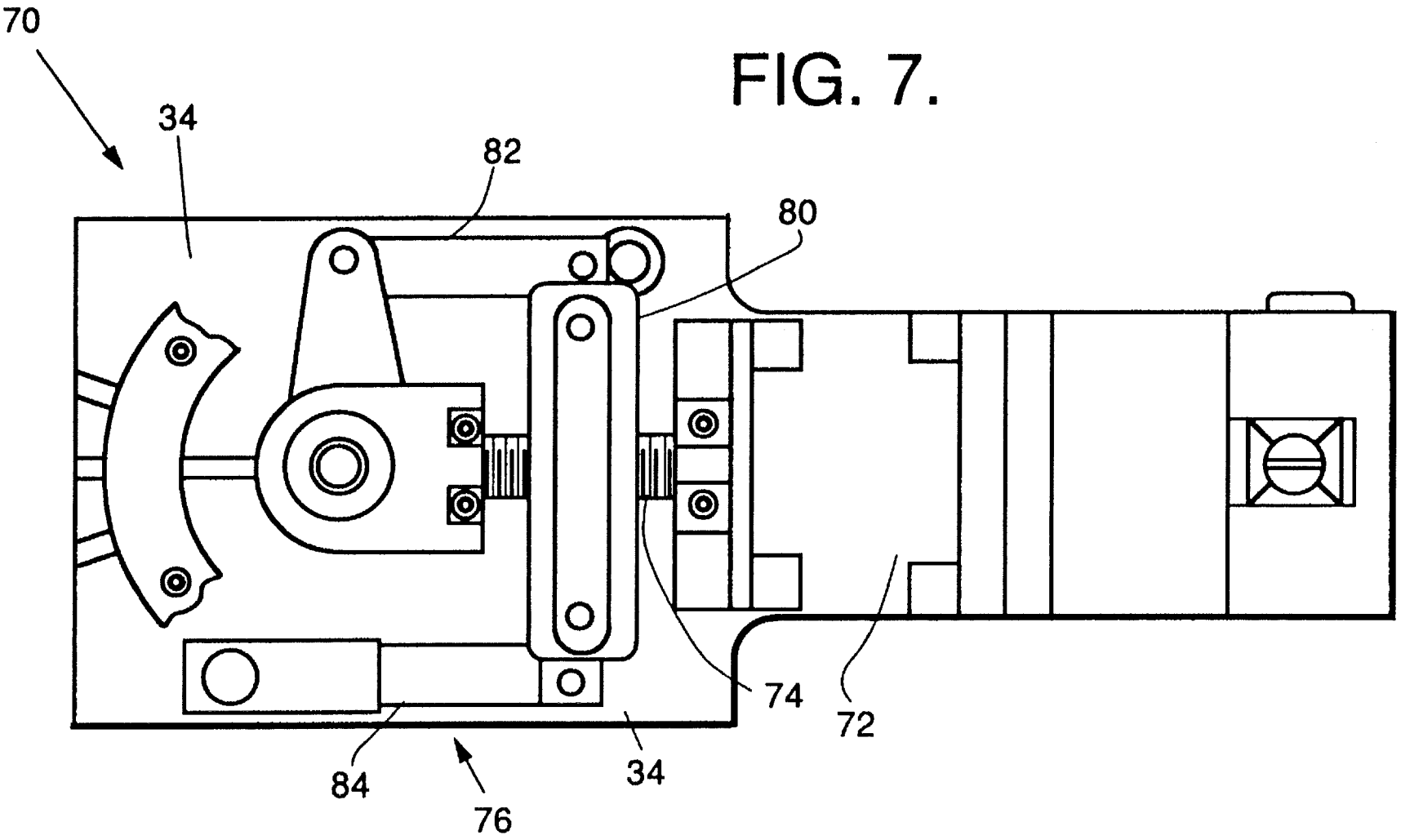
FIG. 7 is a detailed plan view of the actuator and linkage portion of the system of FIG. 2.

FIG. 2 shows an actuating mechanism 70 for controllably rotating the actuator shaft 38 generally, and FIG. 7 depicts the actuating mechanism 70 in more detail. A drive motor 72 is fixed to the base 34. The drive motor 72 is normally of the DC motor type, with an output to a threaded drive shaft 74, but other types of motors can also be used. The movement of the drive shaft 74 is conveyed to the actuator shaft 38 by a linkage 76 that engages the drive shaft 74 and also a drive arm 78 that extends from the side of the actuator shaft 38. Any operable type of linkage can be used.

In its preferred form, the linkage 76 includes a cross arm 80 that is pivotably mounted to an internally threaded block (not visible) that is threadably engaged to the drive shaft 74. One end of the cross arm 80 is pivotably joined to one end of a first side link 82, whose other end is pivotable anchored to the base 34. The other end of the cross arm 80 is pivotably joined to one end of a second side link 84, whose other end is pivotably joined to the drive arm 78.

As the drive motor 72 is operated to rotate the drive shaft 74, the internally threaded block engaged to the drive shaft causes the cross arm 80 to move longitudinally responsive to the rotation of the drive shaft 74. The second side link 84 is also driven longitudinally, causing the actuator shaft 38 to rotate about the control axis 30. The control fin 28 is thereby rotated about the control axis 30. Only small rotations of the control surface 28 are required to steer the missile. Other approaches to driving the actuator shaft can be used.

Figure 8:
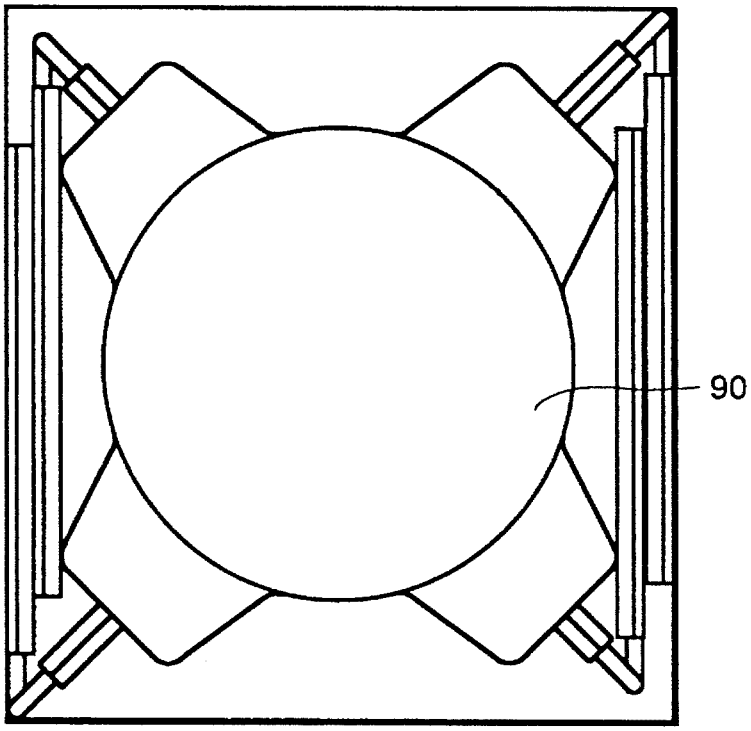
FIG. 8 is a schematic end elevational view showing a missile with stowed control fins using a conventional folded-wing design.
Figure 9:
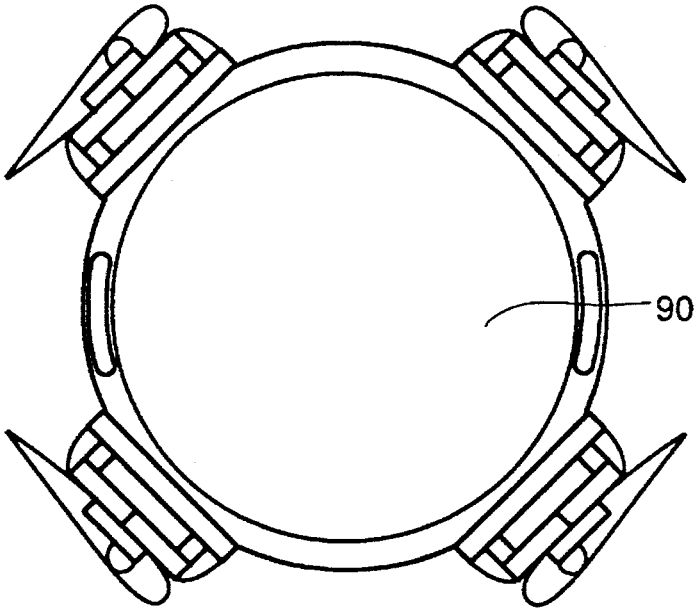
FIG. 9 is a schematic end elevational view showing a missile of the same diameter as that of FIG. 8 with stowed control fins, according to the present approach.

In addition to the other advantages, the present approach reduces the "envelope" or overall external size of the missile for storage and mounting on launchers. FIGS. 8 and 9 show the results of a design process for a hypothetical missile 90. The design variation of FIG. 8 uses a conventional folded-fin approach, while the design variation of FIG. 9 uses the approach of the invention. The design variation of FIG. 9 provides a smaller overall envelope size than the design variation of FIG. 8, so that smaller packaging can be used.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A missile, comprising:

a missile body having a missile body axis;

a control fin;

an actuator shaft rotatable about an axis perpendicular to the missile body axis;

a deployment shaft extending from the control fin in a direction that is not parallel to the actuator shaft;

a deployment shaft bore in the actuator shaft, the deployment shaft being rotatably received with the deployment shaft bore; and a stop fixedly supported on the actuator shaft and positioned to contact the control fin when the control fin is in an extended position;

a locking latch on the control fin; and a locking latch receiver fixedly supported on the stop and positioned to receive the locking latch therein when the control fin is in the extended position.

2. The missile of claim 1, further including an actuator motor; and a linkage extending from the actuator motor to the actuator shaft.

3. The missile of claim 1, further including means for locking the control fin in the extended position.

4. The missile of claim 1, wherein the missile further includes at least one additional control fin;

a respective actuator shaft for each additional control fin, each actuator shaft being rotatable about an axis perpendicular to the missile body axis;

a respective deployment shaft extending from each respective control fin in a direction that is not parallel to the respective actuator shaft; and a respective deployment shaft bore in each respective actuator shaft, each respective deployment shaft being rotatably received within the respective deployment shaft bore.

5. The missile of claim 4, wherein there is a total of four control fins.

6. A missile, comprising:

a missile body having a missile body axis; and at least one control fin, there being for each control fin an actuator shaft rotatable about a control axis perpendicular to the missile body axis, an actuator motor, a linkage extending from the actuator motor to the actuator shaft, a deployment shaft extending from the control fin in a direction that is not parallel to the actuator shaft, a deployment shaft bore in the actuator shaft, the deployment shaft being received within the deployment shaft bore and rotatable within the deployment shaft bore to move the control fin from a folded position parallel and adjacent to the missile body to a extended position parallel to the control axis, a stop fixedly supported on the actuator shaft and positioned to contact the control fin when the control fin is in the extended position, a locking latch on the control fin, and a locking latch receiver fixedly supported on the stop and positioned to receive the locking latch therein when the control fin is in the extended position.

7. The missile of claim 6, wherein the control fin is formed as an airfoil about an airfoil plane and has a longitudinal axis lying in the airfoil plane and extending between a leading edge and a trailing edge of the airfoil, and wherein the deployment shaft is oriented at an angle of about 44.8 degrees to the longitudinal axis measured in the airfoil plane, and at an angle of about 43.6 degrees to the longitudinal axis measured perpendicular to the airfoil plane.

8. The missile of claim 6, further including a bearing that supports the actuator shaft.

9. The missile of claim 6, wherein there is a total of four control fins.

* * * * *